United States Patent [19]

Neth

[11] 4,226,389

[45] Oct. 7, 1980

[54] GOLF BAG SUPPORT STAND

[76] Inventor: Otto Neth, 7321 Corregidor Rd., Vancouver, Wash. 98664

[21] Appl. No.: 919,425

[22] Filed: Jun. 26, 1978

[51] Int. Cl.[2] ..... A63B 55/00

[52] U.S. Cl. ..... 248/96; 248/166

[58] Field of Search ..... 248/96, 166, 148, 150, 248/359, 360, 169, 170, 434, 168; 150/1.5 B

[56] References Cited

U.S. PATENT DOCUMENTS

| | | | |
|---|---|---|---|
| 1,410,989 | 3/1922 | Borthwick | 248/96 |
| 1,471,766 | 10/1923 | Inolfe | 248/96 |
| 1,865,689 | 7/1932 | Hansen et al. | 248/96 |
| 1,895,454 | 1/1933 | Ducat | 248/96 |
| 2,571,088 | 10/1951 | Walton | 248/96 |
| 4,054,256 | 10/1977 | Buck et al. | 248/166 X |

FOREIGN PATENT DOCUMENTS

| | | | |
|---|---|---|---|
| 17450 | of 1905 | United Kingdom | 248/96 |
| 427487 | 4/1935 | United Kingdom | 248/96 |

*Primary Examiner*—J. Franklin Foss

*Attorney, Agent, or Firm*—Kolisch, Hartwell & Dickinson

[57] ABSTRACT

A support stand for supporting a golf bag or the like. The stand comprises a clamp member attachable to the upper edge of the bag, and a pair of legs mounted on the clamp member for pivoting between retracted positions, wherein the legs are disposed adjacent the longitudinal axis of the bag, and extended positions wherein the bag and the two legs form a self-standing tripod. The two legs are constrained to pivot coordinately away from the bag and away from each other.

1 Claim, 10 Drawing Figures

GOLF BAG SUPPORT STAND

BACKGROUND AND SUMMARY

The present invention relates to support stands, and in particular to a support stand for supporting an elongate bag such as a golf bag or the like.

One important object of the present invention is to provide a golf bag support stand having a carrying, or retracted position and a bag-supporting, or extended position.

Yet another object of the present invention is to provide a golf bag support stand having a pair of retractable-extendible legs which are coordinately shiftable by shifting one of the legs only.

Still another object of the invention is to provide a golf bag support stand having a fixed-position leg extending into the bag along its longitudinal axis, and a pair of retractable-extendible legs which, in their extended position, form a self-standing tripod with the fixed-position leg.

Still another object of the invention is to provide a golf bag support stand which is simple in construction and use.

In a preferred embodiment of the invention, the support stand comprises a mounting member adapted to be clamped to the upper edge of a golf bag. A fixed-position leg attached to the mounting member is positioned to extend into the bag, substantially parallel to the longitudinal axis of the bag to support the side thereof. A pair of shiftable legs are journaled to the mounting member for shifting between retracted positions, wherein the legs are adjacent a side of the bag and extended positions, wherein the fixed-position and shiftable legs form a tripod for supporting the golf bag, with the two shiftable legs being skewed with respect to the fixed-position leg. Pivotally attached to the mounting clamp is a guide member having an elongate slot receiving therethrough upper portions of the shiftable legs, whereby such legs are coordinately shifted between their extended and retracted positions.

These and other objects and features of the invention will become more fully apparent with reference to the following detailed description of a preferred embodiment of the invention, and the accompanying drawings.

DRAWINGS

DETAILED DESCRIPTION OF A PREFERRED EMBODIMENT OF THE INVENTION

Figure 2:
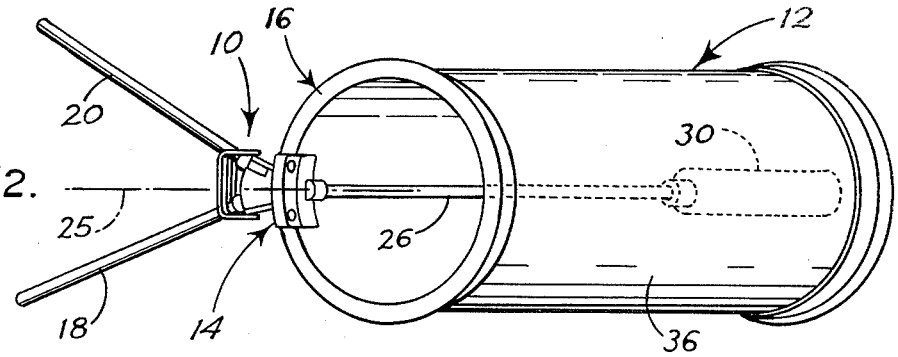
FIG. 2 is a top view of the golf bag and attached support stand of FIG. 1.
Figure 1:
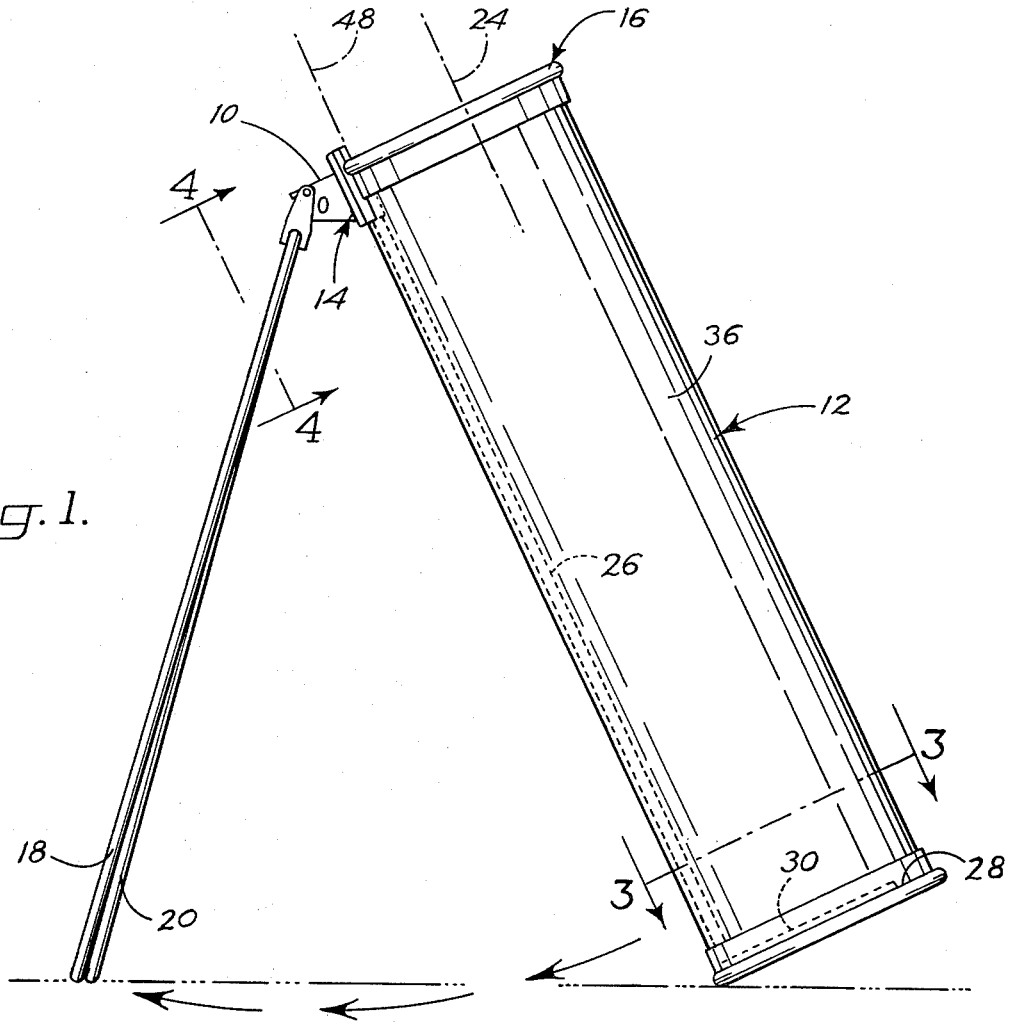
FIG. 1 is a side view of a golf bag and an attached support stand constructed according to a preferred embodiment of the present invention, shown in extended position.

Referring now to the drawings and in particular to FIGS. 1 and 2, there is shown generally at 10 a support stand constructed according to a preferred embodiment of the invention. The stand is shown attached to a conventional golf bag 12, and is to be used to support the bag in the tilted manner shown.

Stand 10 generally comprises a mounting member 14 suitably clamped to the upper edge portion 16 of bag 12. A pair of shiftable legs 18, 20, also referred to herein as first and second legs, respectively, are mounted on member 14 for shifting between retracted and extended positions. In their retracted positions, legs 18, 20 are disposed adjacent the sides of bag 12, substantially parallel to the longitudinal axis 24 (dash-dot line in FIG. 1) of the bag. In their extended positions, shown in FIGS. 1, 2, the legs are swung outwardly from the sides of the bag, with the two legs 18, 20, being skewed with respect to a fixed plane 25 (dash-dot line in FIG. 2) in a manner to be described.

Figure 3:
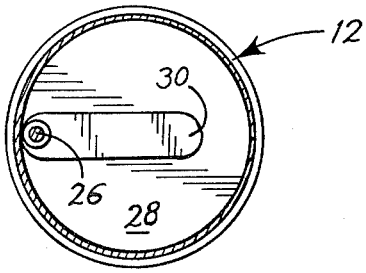
FIG. 3 is a section view, taken generally along line 3—3 in FIG. 1.

Rigidly secured to member 14 and positioned to extend into bag 12, substantially paralleling axis 24, when clamp 10 is attached to the bag, is a third, or fixed-position leg 26. With reference to FIGS. 1–3, leg 26 is dimensioned to extend to the bottom surface 28 of the golf bag. Attached to the lower end of leg 26, adjacent surface 28, is an elongate foot 30 projecting outwardly from leg 26. It can be appreciated with reference to FIG. 1, that leg 26, rigidly secured to the upper portion of the golf bag through mounting member 14, and braced against the bottom surface of the bag by foot 30, provides a fixed-distance support which maintains the bag in the relatively erect position shown in FIG. 1. Thus, with legs 18, 20 in their extended positions, bag 12 and attached stand 10 may be thought of as a tripod, with bag 12 being supported internally along leg 26 of the tripod. Leg 26 is needed for use with flexible sided bags. With more rigid bags it may be unnecessary to use leg 26, as the bag itself will act as one leg of the tripod.

Figures 4, 5, 6, 7, 8, 9, 10:
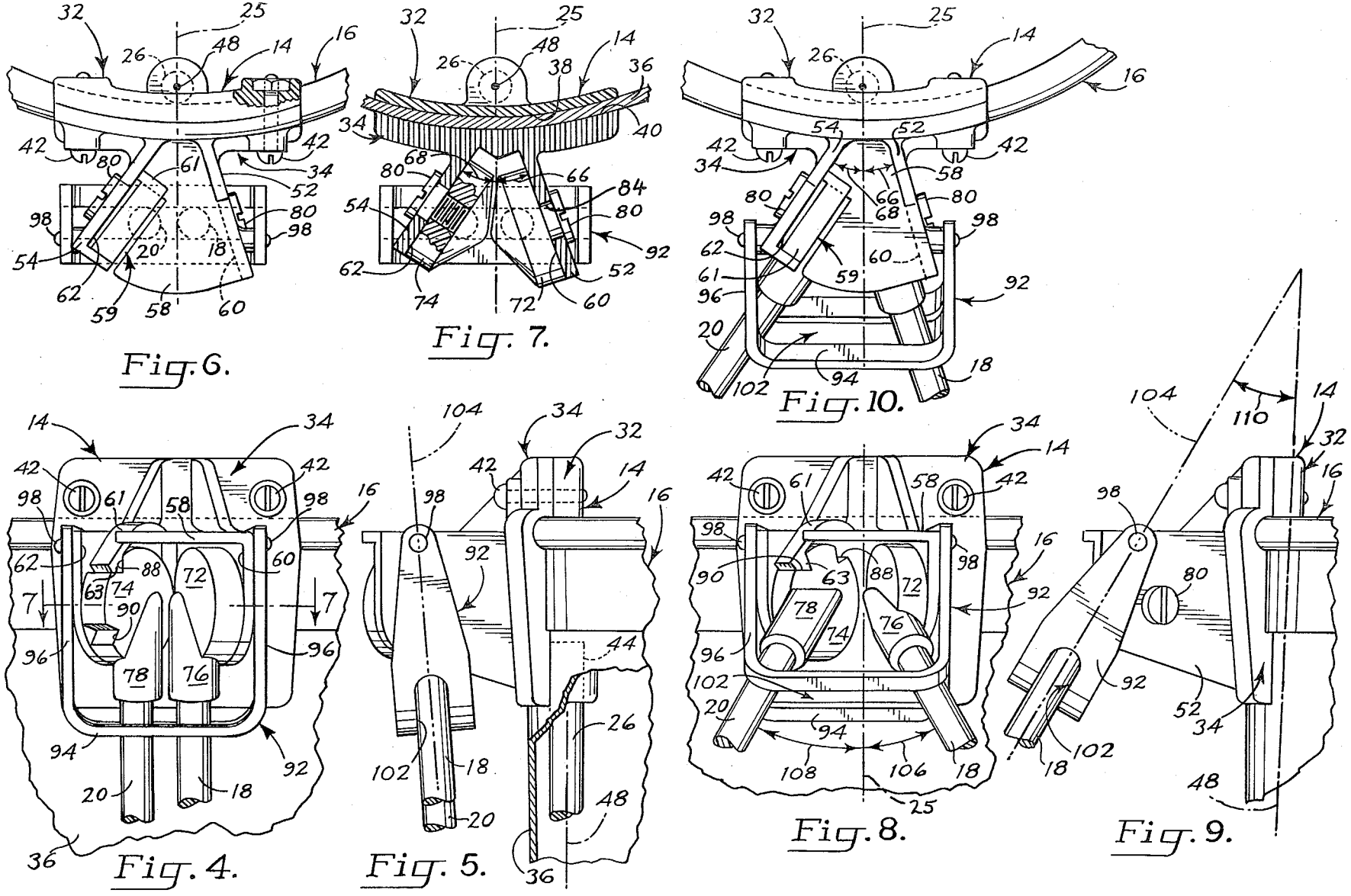
FIG. 4 is an enlarged, fragmentary front view, taken generally along the line 4—4 in FIG. 1, of the golf bag and attached support stand of FIG. 1, but shown in retracted position.
FIG. 5 is a side view of the portion of the invention shown in FIG. 4.
FIG. 6 is a top view of the portion of the invention seen in FIGS. 4, 5.
FIG. 7 is a sectional view taken generally along the line 7—7 in FIG. 4.
FIGS. 8, 9, 10 are similar to FIGS. 4, 5, 6, respectively, but showing the support stand in extended position.

Looking now at FIGS. 4–7, mounting member 14 includes separable inner and outer clamp sections 32, 34, respectively, which are adapted to engage inner and outer surfaces, respectively, of the upper edge portion of bag 12. Sections 32, 34, define, respectively, a pair of mutually adjacent, arcuate surfaces 38, 40, (FIG. 7) which are dimensioned to engage inner and outer sides, respectively, of the upper portion of the golf bag when the two sections are secured together by a pair of clamping bolts 42, as illustrated in FIG. 6. Member 14 may be easily removed from golf bag 12 by loosening bolts 42, permitting sections 32, 34 to be separated sufficiently to remove the same from the upper portion of the golf bag.

As best seen in FIG. 5, leg 26 is mounted within a cavity 44 formed in the lower portion of section 32, being secured therein with a suitable adhesive. The longitudinal axis of leg 26 defines a fixed axis 48 (dash-dot line, FIGS. 1, 5 and 9) which is substantially parallel to axis 24 when member 14 is attached to bag 12 in the manner just described.

Attached to section 34, and projecting outwardly therefrom, are a pair of lugs, or ears, 52, 54, having inwardly facing surfaces 60, 62, respectively. Plane 25, the edge of which is shown in dash-dot line in FIGS. 2, 6, 7, 8 and 10, is disposed between surfaces 60, 62, and extends through axis 48, substantially normal to arcuate surfaces 38, 40. With reference to FIGS. 7 and 10, surfaces 60, 62 are disposed at acute angles 66, 68, respectively, with respect to plane 25, with angle 68 being greater than angle 66.

With reference to FIGS. 6 and 10, the upper edges of lugs 52, 54 are joined by a cover 58. A slot 59, is formed in this cover adjacent lug 54. A flexible detent arm 61 having a detent 63 thereon (FIGS. 4 and 8) is mounted on the cover and extends downwardly through slot 59 for a purpose to be explained. Section 34, including the clamp portion forming surface 40, lugs 52, 54, cover 58 and arm 61 may be integrally formed from a single piece of plastic or metal. Section 32 is similarly formed.

Legs 18, 20 are mounted at their upper ends adjacent surfaces 60, 62, respectively, for pivoting in planes substantially paralleling the planes occupied by surfaces 60, 62, respectively. As seen in FIGS. 4 and 8, the upper ends of legs 18, 20, are secured to a pair of discs 72, 74, respectively, through leg-mounting members 76, 78, respectively. As shown in FIG. 7, discs 72, 74, are internally threaded, and are pivotally mounted adjacent lugs 52, 54, respectively, by bolts 80 extending through central openings 84 in the two lugs. With reference to FIGS. 4 and 8, disc 74 has formed in its periphery a pair of spaced apart detent-receiving notches 88, 90, so positioned that detent 63 on arm 61 is releasably engaged in notch 88 when leg 20 is in its retracted position, as shown in FIG. 4, and releasably engaged in notch 90, when the same leg is in its extended position, as shown in FIG. 8. Arm 61, detent 63 and notches 88, 90 thus form detent means for releasably locking leg 20 in its retracted and extended positions.

Mounted on member 14 for pivoting between retracted and extended positions is a U-shaped guide member 92 having a bottom portion 94 and a pair of upwardly-extending, mutually parallel arms 96 (FIGS. 4, 10). The upper ends of arms 96 are journaled to a pair of axial pins 98, extending outwardly from lugs 52, 54 along a line substantially perpendicular to plane 25. Slot means including an elongate substantially linear guide slot 102 defined within the lower portion of member 92 (FIGS. 9, 10) and extending substantially normal to plane 25, is dimensioned to receive slidingly therein, the upper portions of legs 18, 20. With reference to FIGS. 5 and 9, legs 18, 20, are contained in a shiftable plane denoted by dash-double dot line 104 which bisects slot 102 longitudinally, and which is substantially orthogonal to plane 25. As will be described below, guide member 92 provides guide means for maintaining plane 104 in a preselected angular relationship with respect to plane 25 as legs 18, 20 are shifted from their retracted to their extended positions.

The operation of stand 10 used in conjunction with bag 12 will now be described. With legs 18, 20 shifted to their retracted position, the legs are essentially tucked against the sides of the bag, and the bag can be conventionally carried, such as by a shoulder strap. As seen in FIGS. 4–7, with legs 18, 20 in their retracted position, detent 63 is releasably engaged in notch 88, maintaining leg 20 at the desired retracted position. Similarly, leg 18, which is coupled to leg 20 through guide member 42, is maintained in its retracted position.

To shift legs 18, 20, to their extended position, illustrated in FIGS. 1, 2 and 8–10, either of legs 18, 20, are forceably swung away from the bag, thereby to disengage detent 70 from notch 88. If leg 20 is swung outwardly, such disengagement occurs directly. If leg 18 is swung outwardly, the disengagement occurs through the coupling of leg 18 to leg 20 through member 92. Explaining further, as either leg 18, 20 is shifted from its retracted to extended position, member 92 is shifted correspondingly, shifting with it the other leg.

In their extended positions, in which detent 63 engages notch 90 on disc 74, legs 18, 20, are disposed at first and second acute angles 106, 108, respectively with respect to plane 25, as shown in FIG. 8, and plane 104 containing the two legs is disposed at a third acute angle 110 with respect to fixed axis 48, as illustrated in FIG. 9. It can be appreciated that angles 106, 108 (FIG. 8) are less than angles 66, 68 (FIG. 7), respectively, and related thereto by the same proportionality constant. From the above, it can be appreciated that as legs 18, 20, are shifted from retracted to extended positions, the extent of movement of the legs 18, 20 toward angles 106, 108, respectively, is proportional to the extent of shifting of plane 104 toward angle 110.

From the above, it can be appreciated that shifting of leg 18 within the plane containing surface 60 carries this leg through an angle which has an upward component within plane 25 and an outward component which is normal to, and extends to the right of this plane, in FIGS. 6 and 7. Similarly, shifting of leg 20 within the plane containing surface 62 carries this leg along an angle which has an upward component within plane 25 and an outward component which is parallel to, opposite from, and proportionately greater than the just-described outward angle associated with leg 18. It can also be appreciated that member 92, which pivots along an axis perpendicular to plane 25, couples the movement of legs 18, 20 such that both shift through identical upward angles, when either leg is shifted. Since leg 18, in shifting through a defined upward angle, shifts through a lesser outward angle than does leg 20, in shifting through the same upward angle, movement of leg 18, within its plane, through a defined angle, produces a shifting of leg 20, within its plane, through a defined, proportionately greater angle. Thus, member 92, the axis of rotation of which is asymmetric with respect to the planes 60, 62 within which legs 18, 20 shift, respectively, is also referred to herebelow as means producing swinging of leg 20 through a defined angle, within its plane, as leg 18 is swung through a defined, proportionately smaller angle.

Golf bags generally are carried on the golfer's right side and thus leg 18 will be nearest the golfer's body. Because of the particular construction discussed above, leg 18 will not swing as far from plane 25 or does leg 20. This allows leg 18 to clear the user's body easily and thus allows the legs to be swung to their extended positions while the bag is still carried by the golfer.

A golf bag support stand easily attachable to a conventional golf bag or the like, and having advantageous leg extending features and support features, has thus been disclosed. Various modifications and changes may be made without departing from the spirit of the invention.

It is claimed and desired to secure by Letters Patent:

1. A support stand for supporting an elongate bag such as a golf bag or the like, comprising a mounting member adapted to be attached to an upper portion of said bag, said member having inner and outer clamp sections and means for clamping said sections tightly against inner and outer surfaces of the bag, first and second legs mounted on said member for swinging in first and second planes, respectively, toward and away from said bag when said member is attached thereto, means producing swinging of said second leg through a defined angle within its plane as said first leg is swung through a defined, proportionately smaller angle within its plane, said producing means including a guide member pivotally mounted on said mounting member for swinging toward and away from said bag, when said mounting member is attached thereto, said guide member having an elongate substantially linear slot, the axis of which is asymmetric with respect to said first and second planes, through which slot upper portions of said legs are received for shifting therealong, a disc pivotally mounted on said mounting member from which one of said legs extends, said disc including a pair of notches formed thereon, detent means connected to said mounting member including a flexible arm provided with a detent operable for releasably locking said legs in their extended and retracted positions by engaging a selected notch formed on said disc, and a third leg attached to said mounting member and positioned to extend into the bag, substantially parallel to the longitudinal axis thereof, when said mounting member is attached to the bag.

* * * * *